US006478887B1

(12) United States Patent
Sue et al.

(10) Patent No.: US 6,478,887 B1
(45) Date of Patent: Nov. 12, 2002

(54) BORONIZED WEAR-RESISTANT MATERIALS AND METHODS THEREOF

(75) Inventors: J. Albert Sue, The Woodland, TX (US); Zhigang Fang, The Woodlands, TX (US); Alysia Canson White, Kingwood, TX (US)

(73) Assignee: Smith International, Inc., Houston, TX (US)

( * ) Notice: Subject to any disclaimer, the term of this patent is extended or adjusted under 35 U.S.C. 154(b) by 0 days.

(21) Appl. No.: 09/212,170

(22) Filed: Dec. 16, 1998

(51) Int. Cl.[7] ..... B22F 7/08
(52) U.S. Cl. ..... 148/279; 175/374
(58) Field of Search ..... 419/8, 12, 16; 175/374; 148/279

(56) References Cited

U.S. PATENT DOCUMENTS 3,673,005 A * 6/1972 Kunst ..... 148/6
3,842,921 A * 10/1974 Dill et al. ..... 175/374
3,922,038 A * 11/1975 Scales ..... 308/8.2

(List continued on next page.)

OTHER PUBLICATIONS

A. Sinha, "Boriding (Boronizing)", ASM Handbook, vol. 4: Heat Treating, 1991, pp. 437–447.

H. Hunger and G. Trute, "Boronizing to Produce Wear–resistant Surface Layers", Heat Treatment of Metals, 1994.2, pp. 31–39.

*Primary Examiner*—Daniel J. Jenkins
(74) *Attorney, Agent, or Firm*—Rosenthal & Osha L.L.P.

(57) ABSTRACT

A boronized wear-resistant material that includes a boron-containing composition is disclosed. The boron-containing composition includes tungsten carbide and a compound represented by the formula $W_3MB_3$, where M is selected from the group consisting of iron, nickel, cobalt and alloys thereof. Particularly, a boride layer containing WC and $W_3CoB_3$ may be formed over a cemented tungsten carbide substrate by a suitable boronizing process. Additional compounds present in the boride layer include CoB, $W_2CoB_2$, and WB. A relatively thick and uniform boride layer may be obtained over a carbide substrate to form a wear-resistant body. Such a wear-resistant body may be used to manufacture cutting tools, drawing dies, inserts for an earth-boring bit, face seals, bearing surfaces, nozzles, and so on.

53 Claims, 8 Drawing Sheets

U.S. PATENT DOCUMENTS 3,999,954 A 12/1976 Kolaska et al. ..... 29/182.7
3,999,962 A 12/1976 Drui et al. ..... 51/307
4,236,926 A * 12/1980 Lindholm et al. ..... 75/238
4,268,582 A 5/1981 Hale et al. ..... 428/446
4,289,545 A * 9/1981 Thevenot et al. ..... 148/6.3
4,342,595 A 8/1982 Bourdeau ..... 75/238
4,343,865 A * 8/1982 Graham ..... 428/552
4,404,045 A * 9/1983 Thevenot et al. ..... 148/31.5
4,430,389 A 2/1984 Otani ..... 428/627
4,436,775 A 3/1984 Graham ..... 427/419.7
4,495,006 A 1/1985 Aves, Jr. et al. ..... 148/16.5
4,526,618 A 7/1985 Keshavan et al. ..... 106/1.05
4,555,326 A * 11/1985 Reid ..... 208/48 R
4,596,693 A 6/1986 Ishizuka et al. ..... 419/16
4,626,407 A 12/1986 Veltri et al. ..... 419/18
4,637,837 A * 1/1987 von Matuschka et al. ..... 148/6
4,652,183 A 3/1987 Veltri et al. ..... 407/119
4,661,155 A 4/1987 Heinzel et al. ..... 75/237
4,670,408 A 6/1987 Petzow et al. ..... 501/87
4,679,640 A * 7/1987 Crawford ..... 175/374
4,834,963 A 5/1989 Terry et al. ..... 423/440
4,895,770 A 1/1990 Schintlmeister et al. .... 428/552
4,904,623 A 2/1990 Petzow et al. ..... 501/96
4,923,511 A 5/1990 Krizan et al. ..... 75/252
4,945,073 A 7/1990 Dubensky et al. ..... 501/93
4,961,780 A * 10/1990 Pennington, Jr. ..... 75/238
5,011,514 A 4/1991 Cho et al. ..... 51/295
5,038,640 A * 8/1991 Sullivan et al. ..... 76/108.2
5,089,047 A 2/1992 Buljan et al. ..... 75/236
5,116,416 A * 5/1992 Knox et al. ..... 75/238
5,238,481 A 8/1993 Takagi et al. ..... 75/244
5,271,749 A 12/1993 Rai et al. ..... 51/293
5,271,758 A 12/1993 Buljan et al. ..... 75/232
5,443,337 A 8/1995 Katayma ..... 408/145
5,455,068 A 10/1995 Aves et al. ..... 427/237
5,580,196 A 12/1996 Thompson ..... 408/145
5,611,251 A 3/1997 Katayama ..... 76/108.6
5,639,551 A 6/1997 Ong et al. ..... 428/408
5,655,612 A 8/1997 Grimes et al. ..... 175/401
5,697,994 A 12/1997 Packer et al. ..... 51/309
5,718,541 A 2/1998 Bryant ..... 407/118
5,966,585 A * 10/1999 Sue ..... 428/555
5,981,081 A * 11/1999 Sue ..... 428/564

* cited by examiner

BORONIZED WEAR-RESISTANT MATERIALS AND METHODS THEREOF

FIELD OF THE INVENTION

This invention generally relates to wear-resistant materials and methods of making such materials. More particularly, the invention relates to a boron-containing wear-resistant material and methods of making the material.

BACKGROUND OF THE INVENTION

Cemented carbides, such as cemented tungsten carbide, possess a unique combination of hardness, strength, and wear resistance. Accordingly, they have been extensively used for such industrial applications as cutting tools, drawing dies, and wear parts. Additionally, cemented tungsten carbide has been widely used as cutting inserts on a rock bit for petroleum and mining drilling.

For abrasive wear and nonferrous metal-cutting applications, cemented tungsten carbide in a cobalt matrix (i.e., WC/Co composition) is preferred because of its high strength and good abrasion resistance. For steel machining applications, WC/Co compositions are not suitable because they react to some extent with steel work pieces at high machining speeds. Instead, compositions such as WC/TiC/TaC/Co, TiC/Ni, and TiC/Ni/Mo, are used. However, the use of carbides other than tungsten carbide generally results in a significant strength reduction. As to inserts formed of cemented tungsten carbide, excessive wear and fracture of the inserts frequently occur under severe drilling conditions. Therefore, various attempts have been made to increase the toughness, strength, and wear resistance of cemented carbides for rock drilling and metal machining.

To increase wear resistance in machining and metal-turning applications, carbide, nitride, and carbonitride coatings have been applied to cemented carbide. The coating materials, for example, include titanium nitride (TiN), titanium carbonitride (TiCN), titanium carbide (TiC), titanium aluminum nitride (TiAlN), and aluminum oxide ($Al_2O_3$). These coating materials may be applied to a cemented carbide substrate by physical vapor deposition (PVD) or chemical vapor deposition (CVD). In a CVD coating process, a carbide substrate is heated in a reactor filled with a gas, e.g., hydrogen, at atmospheric or lower pressure. Volatile compounds are added to the reactor to supply the metallic and nonmetallic constituents of the coating. For example, TiC coatings are produced by reacting $TiCl_4$ vapors with methane ($CH_4$) and hydrogen ($H_2$) at 900 to 1100° C. (1650–2000° F). In contrast, in a PVD coating process, the desired coating material is transported from the source to the substrate without involving chemical reactions. Generally, the thickness of the coatings obtained by a PVD or CVD process is less than about 10 microns. Although these thin coatings deposited on carbide cutting inserts have resulted in significant increases in service life, such thin coatings are not suitable for rock drilling applications due to the inadequate thickness. To survive the severe wear and erosion conditions experienced by inserts on a rock bit, a coating preferably should have a thickness greater than 10 microns.

Apart from CVD and PVD, a different method known as "boronizing" has been developed. In contrast to PVD and CVD, boronizing (or boriding) is a thermochemical surface hardening process, in which a boride surface layer is produced via boron diffusion into the surface of a work piece. The process typically involves heating a cleaned substrate to an elevated temperature, preferably for one to twelve hours, in contact with a boronizing compound in the form of a solid powder, paste, liquid, or gaseous medium. The boride surface layer (or boronized layer) typically ranges from about 1.2 microns to 15 microns, depending on the substrate metal, boronizing time, and temperature.

Because ferrous metals and nonferrous metals may be readily boronized, metal boronizing has been applied to make metal components for pneumatic transport systems, plasticating units in plastics processing, automobile gear systems, components for mills, and pumps and valves for chemical plants.

On the other hand, boronized cermet material (e.g., cemented carbides) has only limited use due to the limited thickness obtainable by existing boronizing techniques. For example, boronizing has been used to manufacture extrusion dies and cutting tools (which require a relatively thin boride layer). However, inserts formed of boronized carbide have not been successfully employed for petroleum and mining drilling applications due to the inadequate thickness of, and inconsistent quality in, the boride layer.

For the foregoing reasons, the benefits of boronizing cemented carbides to produce a relatively thick boride layer have not been fully realized. Therefore, there is a need to explore a method of obtaining a relatively thick boride layer by boronizing cemented carbides. Furthermore, it also is desirable to obtain a boronized wear-resistant material with improved wear resistance, toughness, and/or fracture strength.

SUMMARY OF THE INVENTION

In one aspect, the invention relates to a boron-containing composition which comprises tungsten carbide and one or more compounds represented by the formula $W_3MB_3$, where M is selected from the group consisting of iron, nickel, and cobalt. In some embodiments, the boron-containing composition includes a compound represented by the formula $W_3CoB_3$. The boron-containing composition may further comprise CoB, $W_2CoB_2$, and WB.

In another aspect, the invention relates to a boron-containing composition obtained by the following method. The method includes: (a) providing a substrate formed of cemented tungsten carbide in a cobalt matrix; (b) contacting the substrate with a boron-yielding material; and (c) heating the substrate and the boron-yielding material to at least 800° C. to form a compound having the formula $W_3CoB_3$.

In still another aspect, the invention relates to a wear-resistant body which includes a substrate and a boride layer over the substrate. The boride layer includes a compound represented by the formula $W_3CoB_3$. In some embodiments, the boride layer of the wear-resistant body also may include CoB, $W_2CoB_2$, and WB. It may further include tungsten carbide. Preferably, the weight percent of $W_3CoB_3$ in the boride layer in the boride layer should be in the range of about 2% to about 16%. The weight percent of the tungsten carbide in the boride layer preferably should exceed about 60%. The weight percent of CoB in the boride layer preferably should be in the range of from about 8% to 20%. Furthermore, the weight percent of WB in the boride layer preferably should be up to about 2%. In some embodiments, the substrate of the wear-resistant body may be formed of a carbide in a metallic matrix selected from the group consisting of iron, nickel, cobalt, and alloys thereof. The substrate may further include one or more of WC, TaC, VC, and TiC. For example, the substrate of the wear-resistant body may be formed of cemented tungsten carbide in a cobalt matrix. The average grain size of the tungsten carbide in the substrate preferably should be in the range of about 1 micron to about 6 microns. The wear-resistant body may be used to form a face seal, a bearing surface, a thrust plug, and a nozzle. It also may be used to form a component of a rock bit.

In yet another aspect, the invention relates to a wear-resistant body which comprises a substrate formed of cemented tungsten carbide in a cobalt matrix and a boride layer over the substrate. The boride layer includes WC, $W_3CoB_3$, CoB, $W_2CoB_2$, and WB.

In yet still another aspect, the invention relates to a wear-resistant body obtained by the following method. The method comprises: (a) providing a substrate formed of cemented tungsten carbide in a cobalt matrix; (b) contacting the substrate with a boron-yielding material; and (c) heating the substrate and the boron-yielding material to at least 800° C. to form a boride layer over the substrate. The boride layer includes tungsten carbide and a compound having the formula $W_3CoB_3$.

In one aspect, the invention relates to a hard material insert for an earth-boring bit. The insert comprises an inner core formed of a carbide and an outer layer integral with the inner core. The outer layer includes a compound represented by the formula $W_3CoB_3$. In some embodiments, the outer layer further includes CoB, $W_2CoB_2$, and WB. It also may include WC. Preferably, the weight percent of $W_3CoB_3$ in the outer layer should be in the range of about 2% to about 16%. The weight percent of WC in the outer layer preferably should exceed about 60%. The weight percent of CoB in the outer layer preferably should be in the range of about 8% to about 20%. Furthermore, the weight percent of WB in the outer layer preferably should be up to about 2%. In some embodiments, the carbide of the inner core is dispersed in a metallic matrix selected from the group consisting of iron, nickel, cobalt, and alloys thereof. In addition, it may further include one or more of WC, TaC, VC, and TiC.

In another aspect, the invention relates to an insert obtained by the following method. The method comprises: (a) providing an insert formed of cemented tungsten carbide in a cobalt matrix; (b) contacting the insert with a boron-yielding material; and (c) heating the insert and the boron-yielding material to at least 800° C. to form a boride layer on the insert. The boride layer includes tungsten carbide and a compound having the formula $W_3CoB_3$.

In still another aspect, the invention relates to an earth-boring bit. The earth-boring bit comprises: (a) a bit body having a leg; (b) a roller cone rotatably mounted on the leg; and (c) an insert protruding from the roller cone. The insert has an inner core formed of a carbide and an outer layer integral with the inner core, and the outer layer includes a compound represented by the formula $W_3CoB_3$.

In yet another aspect, the invention relates to a method of making a boron-containing composition. The method comprises: (a) providing cemented tungsten carbide in a cobalt matrix; (b) contacting the cemented tungsten carbide with a boron-yielding material; and (c) heating the cemented tungsten carbide and the boron-yielding material to at least 800° C to form a compound having the formula $W_3CoB_3$. In some embodiments, an activator and a filler are used when the cemented tungsten carbide is contacted with the boron-yielding material. The boron-yielding material may be selected from the group consisting of boron carbide, ferroboron, amorphous boron and combinations thereof. The activator may be selected from the group consisting of $NaBF_4$, $KBF_4$, $(NH_4)_3BF_4$, $NH_4Cl$, $Na_2CO_3$, $BaF_2$, $Na_2B_4O_7$ and combinations thereof. The filler may be selected from the group consisting of SiC, C, $Al_2O_3$ and combinations thereof.

In yet still another aspect, the invention relates to a method of making a wear-resistant body. The method comprises: (a) providing a substrate formed of cemented tungsten carbide in a cobalt matrix; (b) contacting the substrate with a boron-yielding material; and (c) heating the substrate and the boron-yielding material to at least 800° C. to form a boride layer over the substrate. The boride layer includes tungsten carbide and a compound having the formula $W_3CoB_3$. In some embodiments, the substrate may be an insert.

In still anther aspect, the invention relates to a method of making a rock bit. The method comprises: (a) providing an insert formed of cemented tungsten carbide in a cobalt matrix; (b) contacting the insert with a boron-yielding material; (c) heating the insert and the boron-yielding material to at least 800° C. to form a boronized insert having a boride layer as an outer surface, the boride layer including tungsten carbide and a compound having the formula $W_3CoB_3$; (d) securing a portion of the boronized insert in a roller cone; and (e) rotatably mounting the roller cone to a leg attached to a bit body.

DETAILED DESCRIPTION OF PREFERRED EMBODIMENTS

Figure 1:
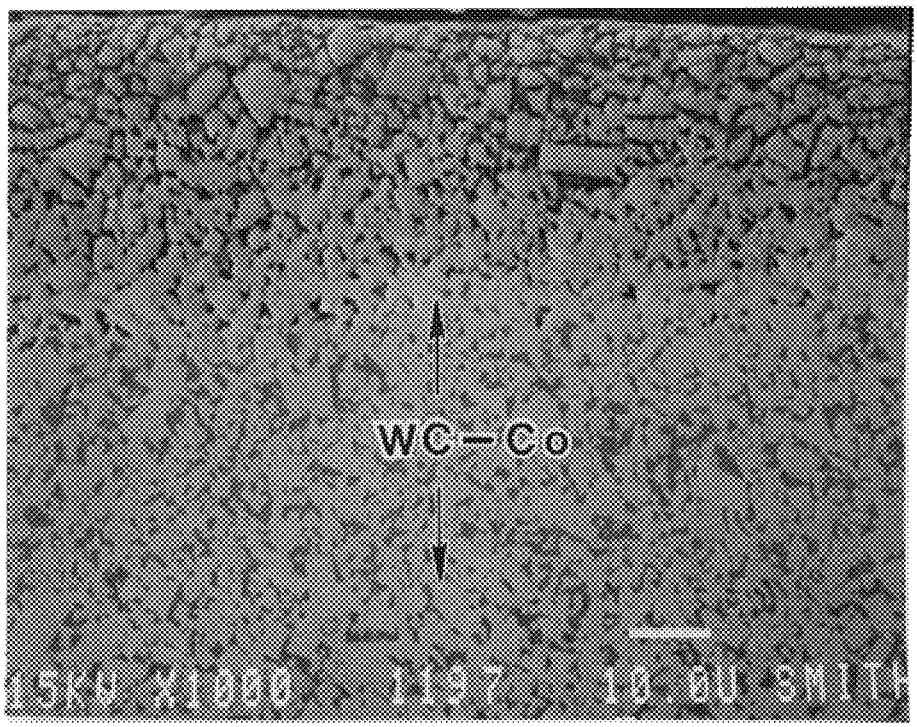
FIG. 1 is one photomicrograph showing the microstructure of a boronized layer on a WC/Co substrate in accordance with one embodiment of the invention.

Embodiments of the invention provide a boronized wear-resistant material that includes a boron-containing composition. The boron-containing composition includes tungsten carbide and one or more compounds represented by the formula $W_3MB_3$, where M is selected from the group consisting of iron, nickel, and cobalt. It is found that a relatively thick and uniform boride layer may be obtained over a carbide substrate to form a wear-resistant body. Such a wear-resistant body has increased hardness, toughness, and fracture toughness which make it suitable for applications under severe wear and erosion conditions.

Embodiments of the invention are based, in part, on the discovery that a new phase represented by the formula $W_3CoB_3$ may be formed in a boride layer under certain boronizing conditions. As mentioned previously, boronizing or boriding is a thermochemical surface-hardening process in which boron atoms diffuse into a metal or cermet surface to form a hard boride layer (or layers). The resulting boride layer may include a single-phase boride or a multiple-phase boride layer. The morphology, growth, and phase composition of the boride layer largely are dependent upon the boronizing conditions and the substrate material. The microhardness of the boride layer also depends strongly on the composition and structure of the boride layer as well as the composition of the substrate material. Suitable boronizing methods include a pack cementation process, gas boronizing process, plasma assisted boronizing process, liquid boronizing process, fluidized bed reactor process, paste boronizing process, etc.

Preferably, the pack cementation boronizing process is used to boronize cermet materials, although other processes also are feasible. In a pack cementation boronizing process (also known as powder-pack boronizing), a substrate material or a work piece is placed in a suitable container and embedded in a boronizing agent. The container is placed in a furnace and heated to a temperature ranging from 700 to 1100° C. for a desired duration of time. In some cases, boronizing may be carried out in the presence of a protective gas. This is achieved either by packing the container into a protective gas retort and heating it in a chamber furnace or by heating it in a chamber furnace supplied with a protective gas. Suitable protective gases may include pure argon, pure nitrogen, pure hydrogen, and mixtures thereof. The boronizing agent generally includes a boron-yielding substance, an activator, and a filler. Suitable boron-yielding substances include, but are not limited to, boron carbide ($B_4C$), ferroboron, and amorphous boron. Ferroboron has a formula $FeB_x$, where x may be zero or a positive integer. Representative ferroboron includes FeB and $FeB_2$. Suitable activators include, but are not limited to, $NaBF_4$, $KBF_4$, $(NH_4)_3BF_4$, $NH_4Cl$, $Na_2CO_3$, $BaF_2$, and $Na_2B_4O_7$, Furthermore, suitable fillers or diluents include, but are not limited to, SiC, C (carbon), and $Al_2O_3$.

Phase analysis of a resulting boride layer was achieved by using x-ray micro-diffraction. In this technique, an x-ray beam with a diameter of about 250 microns was used to focus on a desired area of the boride layer. The phases present in the boronized layer were identified by matching the diffraction profiles using a computerized search-and-match program. The program searches and matches the diffraction angles and intensities of compound profiles documented in the ICDD (International Center for Diffraction Data) files. The phases identified in a boronized layer include CoB, WB, WCoB, $W_2CoB_2$, $W_3CoB_3$, and WC. While CoB, WCoB, $W_2CoB_2$, and $W_3CoB_3$ typically have an orthorhombic structure, WB generally is tetragonal, and WC hexagonal. It is believed that the presence of $W_3CoB_3$ in a boronized layer including WC has not yet been reported. As will be seen later, the presence of $W_3CoB_3$ in a boronized layer has resulted in increased hardness, toughness, and/or strength.

In addition to phase identification, the weight percentage of each phase in the boride layer was estimated, which was based on the peak intensities of a diffraction profile. Quantitative analysis by x-ray diffraction is a known technique. For example, it is described in B. D. CULITY, ELEMENTS OF X-RAY DIFFRACTION 407–09 (1978).

The intensity of an X-ray diffracted beam from phase α in a mixture may be expressed by the following equation:

$$I_\alpha = K_\alpha C_\alpha / \mu_m$$

where $C_\alpha$ is the volume fraction of phase α in the mixture, $\mu_m$ is the linear absorption coefficient, and $K_\alpha$ is a constant for a given crystal structure α at a given diffraction line and experimental conditions. The equation can be written in terms of the weight of phase α and the mixture.

$$I_\alpha = K_\alpha (W_\alpha / p_\alpha) / [(W_m / p_m) \mu_m]$$

where $W_\alpha$ and $p_\alpha$ are the mass and density of phase α, and $W_m$ and $p_m$ are the mass and density for the mixture, respectively. Transposing the above equation, the following expression is obtained:

$$W_\alpha = I_\alpha [(W_m / p_m) \mu_m] / (K_\alpha / p_\alpha).$$

Considering a two-phase mixture containing phase α and phase β, the mass fraction ($\omega_\alpha$) of phase α in the mixture is: where $\kappa_\alpha = K_\alpha / p_\alpha$ and $\kappa_\beta = K_\beta / p_\beta$. Here, $\kappa_\alpha / \kappa_\beta$ can be experimentally determined. For example, with an assumption of complete formation of CoB from Co during the boronizing process, $\kappa_{WC} / \kappa_{CoB}$ is approximately 3.6 in the boronized sample which contains WC and CoB.

In a multi-phase boronized sample, the above relation is expressed as the following:

In embodiments of the invention, the mass fractions of phases in a boronized sample containing multiple boride phases were calculated using the above equation, with an assumption of $\kappa_{WC} / \kappa_{W3CoB3} = 1$ and $\kappa_{WC} / \kappa_{WB} = 1$.

To measure the mechanical properties of the boronized layer, a series of boronized carbide samples were subjected to a low-stress abrasion test and a high-stress abrasion test to evaluate the wear properties of these samples. The low-stress abrasion test was conducted in accordance with ASTM G65, and the high-stress abrasion test was conducted in accordance with ASTM B611. While low-stress wear resistance generally is related to the hardness of a tested material, high-stress wear resistance is indicative of both the hardness and toughness of the tested material.

Briefly, in the ASTM G65 test (i.e., the low-stress abrasion wear test), abrasive particles of semi-rounded 50/70 mesh (210/300 μm) silica sand were fed between a test material (such as the boronized carbide sample) and a rotating chlorobutyl rubber wheel. The test material was pressed against the rotating wheel at a specific force of 130 N (30 pounds). The stress exerted on the abrasive particles was low enough to not crush the abrasive particles in this test. The rotating speed of the wheel was about 200±10 rpm, and the sand flow rate was about 380 to 430 g/min. The weight loss of the test material was measured by weighing each sample before and after a 6000 revolution test and then converted to volume loss (in cubic centimeters per 1000 revolutions). The smaller the wear number is, the better wear resistance the material has.

In the ASTM B611 (i.e., the high-stress abrasion wear test), the abrasive particles used in the test were 30 mesh (590 μm) angular aluminum-titanium oxide. They were fed and crushed between an annealed AISI 1020 steel wheel and the test material. Some degree of impact on the test material was encountered. The abrasive particles in the slurry were fed between the test material and the wheel by the rotating wheel at 100±10 rpm. The test material was pressed against the rotating wheel with a 20 kg force for 1000 revolutions. A wear number was obtained and expressed as the reciprocal of the volume loss (in cubic centimeters) of the test material per revolution. In this test, the larger the number is, the better the wear resistance is.

To obtain boronized tungsten carbide according to embodiments of the invention, a number of samples formed of cemented tungsten carbide in a cobalt matrix were prepared. In addition to WC/Co, the sample may further include TaC, VC, TiC, and other carbides. The samples were in the form of coupons (0.25"×1.0"×2.0"). Various grades of cemented tungsten carbide also were included. The grade of a cemented tungsten carbide is designated by a three-digit number. The first digit indicates the average grain size of tungsten carbide particles in the cemented tungsten carbide, whereas the last two digits indicate the approximate weight percentage of the cobalt matrix in the cemented tungsten carbide. For example, Grade 208 indicates that it includes approximately 8% by weight of cobalt and the average grain size of tungsten carbide particles is about 2 microns. The following carbide grades were used in embodiments of the invention: 208, 308, 508, 311, 411, 510, 416, 616, and 816. However, it should be understood that any cemented tungsten carbide compositions may be used as well. Before boronizing, the surface of the coupons was ground to a $R_a$ of about 8–19 micro-inch to facilitate the subsequent boronizing process. $R_a$ is an international parameter of roughness, and it is the arithmetic mean of the departures of a surface profile from the mean line.

Boronizing primarily was done in a pack cementation process. Two kinds of boronizing agents were used. The first boronizing agent included $B_4C$, C (carbon), and $KBF_4$, and the second boronizing agent included $B_4C$, SiC, C, and $KBF_4$. It is noted that the first boronizing agent is preferred because it has a higher reactivity, and it also prevents powder agglomeration. In one embodiment, the boronizing agent used includes about 40% $B_4C$, about 50% carbon, and about 10% $KBF_4$.

After the boronizing agent is selected, it is packed with a cemented carbide coupon prepared as described above in a container and heated to a temperature ranging from about 860° C. to 1000° C. for about 2–16 hours. Of course, boronization that occurs at other conditions also may be feasible.

Upon completion, the cemented carbide coupon is removed from the container and cleaned for subsequent analysis. A wear-resistant body or structure thus is obtained. Such wear-resistant body includes a boride layer over a cemented tungsten carbide substrate. The thickness of the boride layer may be measured by examining the cross sectional area of the boronized sample by scanning electron microscopy (SEM).

It is found that the thickness of the boride layer depends significantly on the boronizing temperature and time, as well as the cobalt content of the substrate material. When the first boronizing agent was used, thicknesses of 25 microns and 75 microns were obtained on a Grade 416 cemented carbide coupon for 880° C. and 1000° C. for 8 hours, respectively. It also is found that when a tungsten carbide coupon containing 10% cobalt was boronized at 1000° C. for approximately 8 hours, the thickness of a resulting boride layer was about 60 microns. When comparative studies were conducted with the two boronizing agents, it was found that the first boronizing agent was more effective than the second boronizing agent in forming a boride layer. In addition, the first boronizing agent may be readily removed from a boronized coupon after boronizing, while the second boronizing agent sometimes "caked up".

FIG. 1 shows the typical microstructure of a boride layer over a cemented tungsten carbide substrate. The carbide grade used was Grade 416 WC/Co, and the substrate was boronized at about 880° C. for about 8 hours. It can be seen from FIG. 1 that there is no distinct boundary between the boride layer and the cemented tungsten carbide substrate. The boride layer appears to be integral with the substrate.

Figure 2:
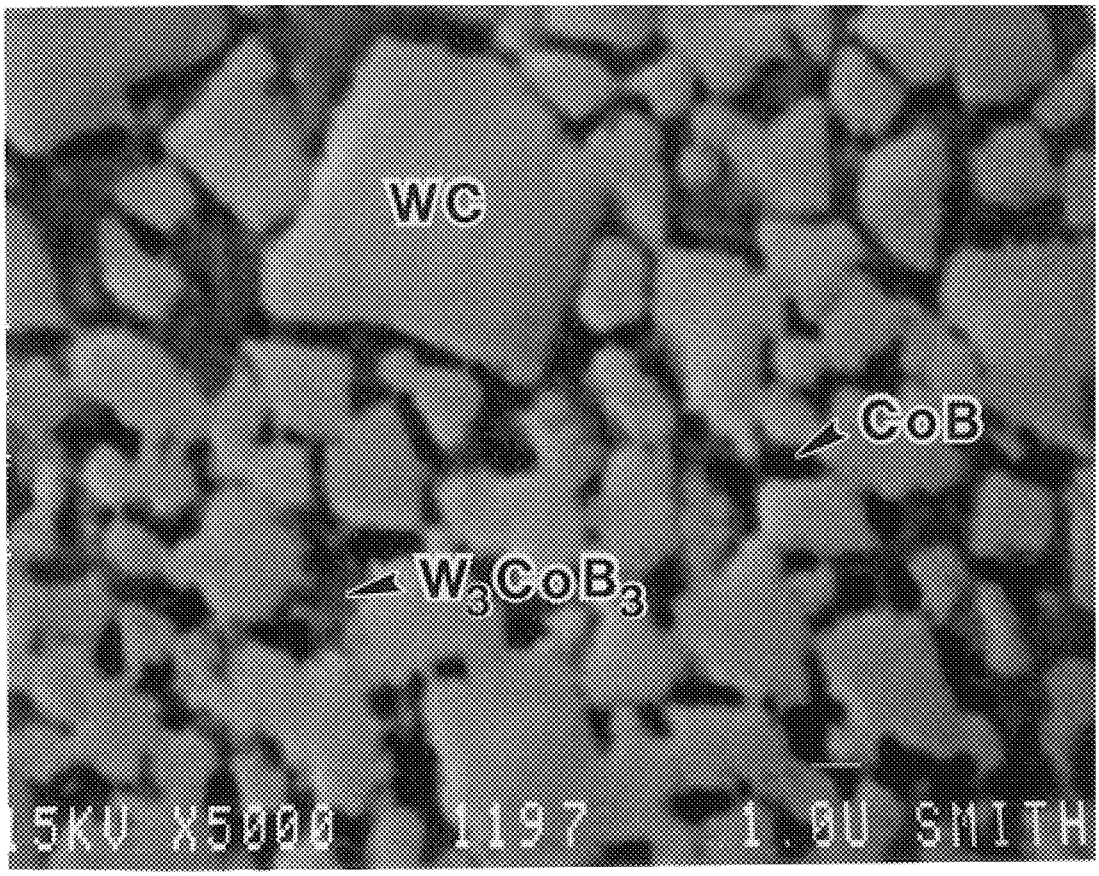
FIG. 2 is another photomicrograph showing the morphology of WC, CoB, and $W_3CoB_3$ phases in a boronized layer according to another embodiment of the invention.

FIG. 2 shows the typical morphology of WC, CoB, and $W_3CoB_3$ in a boride layer. The three phases are identified in the figure. It appears that the WC particles in the boride layer are relatively smaller than those in the substrate. This may indicate that tertiary tungsten borides, such as $W_3CoB_3$, form by consuming WC, CoB, and/or Co.

The following examples further illustrate the embodiments of the invention and are not intended to limit the scope of the invention as otherwise described herein.

EXAMPLE 1

This example illustrates the correlation between the phase composition in a boride layer and boronizing conditions. A number of samples including Grade 416 tungsten carbide in a cobalt matrix were boronized at a temperature from about 860° C. to about 900° C. for about 8–16 hours. It was found that the primary phases in the resulting boride layers include WC, CoB, and $W_3CoB_3$. The phase composition of the resulting boride layer for each sample is listed in Table 1.

TABLE 1

Phase Compositions in Boride Layer Over Grade 416 WC/Co Substrate At Various Temperatures And Times

| Experiment No. | Temp. (° C.) | Time (hour) | WC (wt. %) | CoB (wt. %) | $W_3CoB_3$ (wt. %) | WB (wt. %) |
|---|---|---|---|---|---|---|
| 1 | 860 | 8 | 80.5 | 17.0 | 2.1 | 1.5 |
| 2 | 860 | 12 | 80.3 | 15.4 | 2.8 | 1.4 |
| 3 | 860 | 16 | 79.9 | 14.8 | 5.3 | 0 |
| 4 | 880 | 8 | 83.8 | 11.3 | 4.9 | 0 |
| 5 | 880 | 12 | 80.3 | 11.8 | 7.9 | 0 |
| 6 | 880 | 16 | 72.0 | 15.7 | 11.8 | 0 |
| 7 | 900 | 8 | 78.6 | 11.9 | 9.5 | 0 |
| 8 | 900 | 12 | 75.6 | 8.4 | 16.0 | 0 |
| 9 | 900 | 16 | 63.0 | 10.0 | 27.0 | 0 |

As indicated by the data in Table 1, a small amount of WB up to about 1.5 wt % was observed in the boride layer at 860° C. up to 12 hours. As the boronizing time or increases, WB gradually diminishes and then completely vanishes. Furthermore, for a given temperature between about 860° C. and about 9000° C., the WC phase content in the boride layer decreases with increasing boronizing time, while the content of $W_3CoB_3$ increases. This appears to indicate that the formation of $W_3CoB_3$ may occur at the expense of WC, WB, and CoB because the rate of formation of $W_3CoB_3$ seems to be closely related to the rate of dissolution of WC.

A comparison study was carried out with respect to two grades of cemented tungsten carbide in a cobalt matrix: Grade 416 and Grade 616. Coupons of both grades were boronized at about 880° C. for about 8, 12, and 16 hours, respectively. Table 2 indicates the primary phase composition in the resulting boride layers.

TABLE 2

Comparison of Phase Compositions Between Boronized Grades 416 and 616 WC/Co

| Carbide Grade | Temperature (° C.) | Time (hour) | WC (wt. %) | CoB (wt. %) | $W_3CoB_3$ (wt. %) |
|---|---|---|---|---|---|
| 416 | 880 | 8 | 83.8 | 11.3 | 4.92 |
| 416 | 880 | 12 | 80.3 | 11.8 | 9.01 |
| 416 | 880 | 16 | 72.0 | 15.7 | 11.8 |
| 616 | 880 | 8 | 83.3 | 11.7 | 5.0 |
| 616 | 880 | 12 | 80.0 | 11.2 | 8.8 |
| 616 | 880 | 16 | 74.7 | 13.4 | 11.93 |

It appears that the phase composition of the resulting boride layer is not substantially affected by changing the average grain size of tungsten carbide particles by about 2 microns.

With respect to the phase composition of a boride layer obtained in accordance with embodiments of the invention, it generally is observed that WCoB is the predominant phase when the boronizing time was shorter than about 4 hours or when the diffusion potential of a boron-yielding substance was relatively low. On the other hand, $W_3CoB_3$ becomes the predominant phase as the boronizing temperature or time increases.

EXAMPLE 2

This example illustrates the correlation between the wear properties of a boride layer and the boronizing temperature. In this example, a series of coupons formed of Grade 416 WC/Co were boronized using the first boronizing agent at a temperature from about 860° C. to 900° C. for about 8 to 16 hours. The resulting boronized carbide coupons were subjected to the low-stress abrasion test and the high test abrasion test. The data are tabulated in Table 3.

TABLE 3

Wear Resistance of Boronized Grade 416 WC/Co At Various Temperatures and Times

| Sample No. | Temperature (° C.) | Time (hour) | Low-stress Wear Number ($10^{-3}$ cc/1000 revolution) | High-stress Wear Number (revolution/cc) |
|---|---|---|---|---|
| 10 | 860 | 8 | 0.4 | 17.9 |
| 11 | 860 | 12 | 0.4 | 60.6 |
| 12 | 860 | 16 | 0.4 | 132.5 |
| 13 | 880 | 8 | 0.3 | 18.8 |
| 14 | 880 | 12 | 0.3 | 94.9 |
| 15 | 880 | 16 | 0.3 | 56.4 |
| 16 | 900 | 8 | 0.3 | 34.8 |
| 17 | 900 | 12 | 0.3 | 25.2 |
| 18 | 900 | 16 | 0.4 | 14.6 |
| Reference (Grade 416) | n/a | n/a | 2.9 | 2.2 |

As a reference, the low-stress abrasion wear-resistant number and the high-stress abrasion wear-resistant number for untreated Grade 416 WC/Co also are included in Table 3. As mentioned previously, a lower low-stress abrasion wear number and a higher high-stress abrasion wear number are more desirable. As indicated by Table 3, the low-stress abrasion wear numbers for the boronized carbide coupons are significantly lower than the untreated tungsten carbide referenced, there is no significant difference among the low-stress wear numbers obtained at different boronizing temperatures or times. In contrast, the high-stress abrasion wear numbers exhibit some temperature and time dependence. It appears that boronizing at about 860° C. for about 16 hours or at about 880° C. for about 12 hours is more desirable.

EXAMPLE 3

This example indicates that the phase composition of a boride layer has substantial influence on the wear resistance of boronized tungsten carbide. In this example, boronized tungsten carbide with different phase composition of the resulting boride layer was obtained. After the phase composition was determined, the various samples were subjected to the low-stress abrasion wear test and the high-stress abrasion wear test. The data are summarized in Table 4.

Figure 4A:
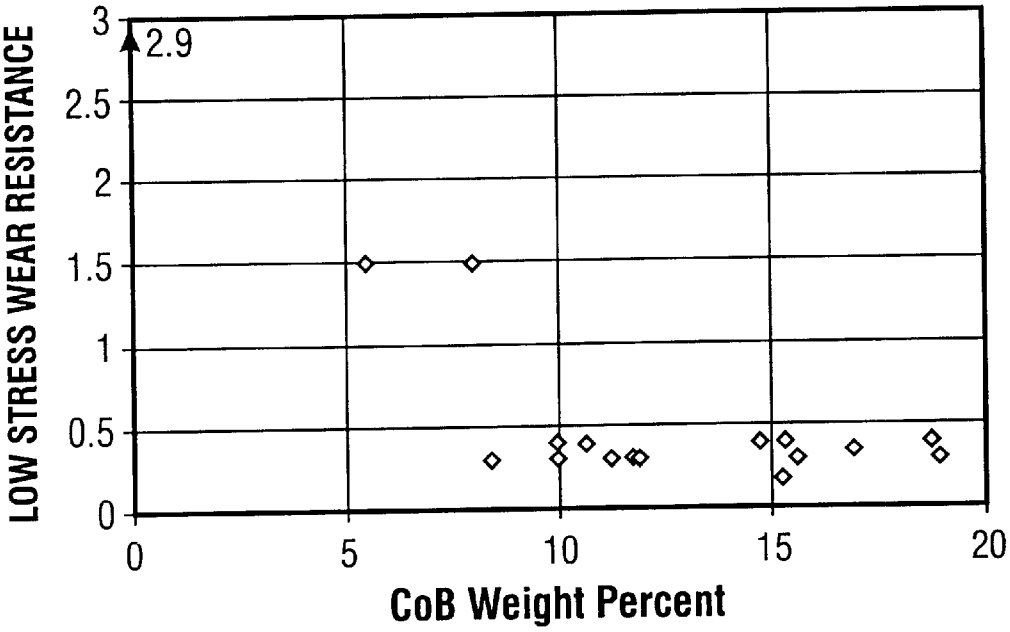
FIG. 4A is a graph showing the relationship between the low-stress wear resistance of a boronized WC substrate and the CoB weight percentage in the boride layer according to one embodiment of the invention.
Figure 4B:
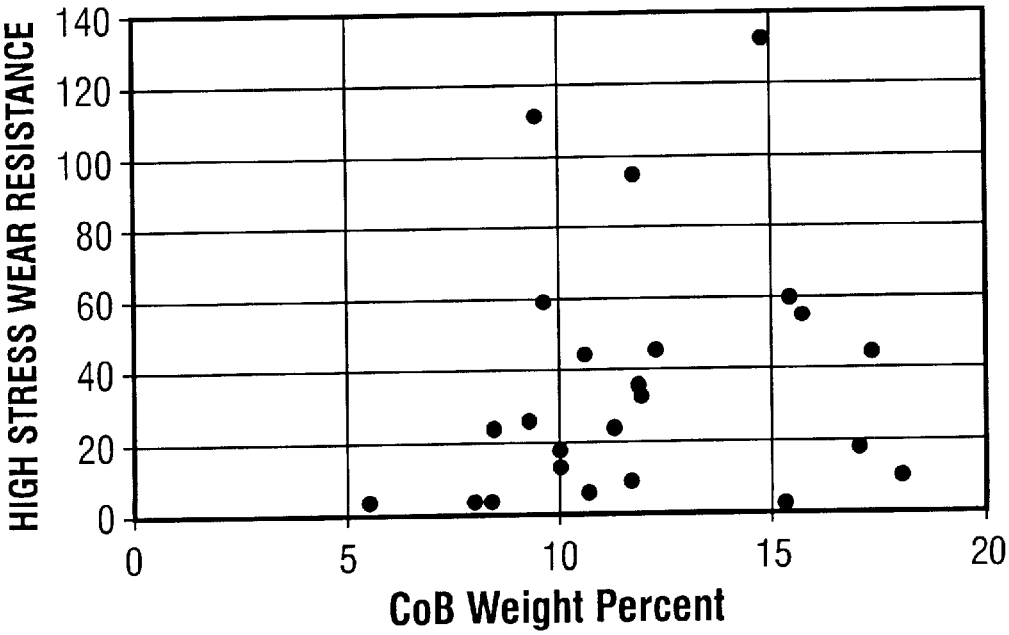
FIG. 4B is a graph showing the relationship between the high-stress wear resistance of a boronized WC substrate and the CoB weight percentage in the boride layer according to one embodiment of the invention.

It is found that a boride layer containing only WC and WCoB showed little or no improvement in both high-stress wear resistance and low-stress wear resistance. The formation of CoB was found to increase wear resistance. This is supported by the data in Table 4, and the data are plotted in FIG. 4A and FIG. 4B. Specifically, when the CoB content exceeds approximately 8% by weight, the low-stress wear numbers generally fall below 0.5.

Figure 5A:
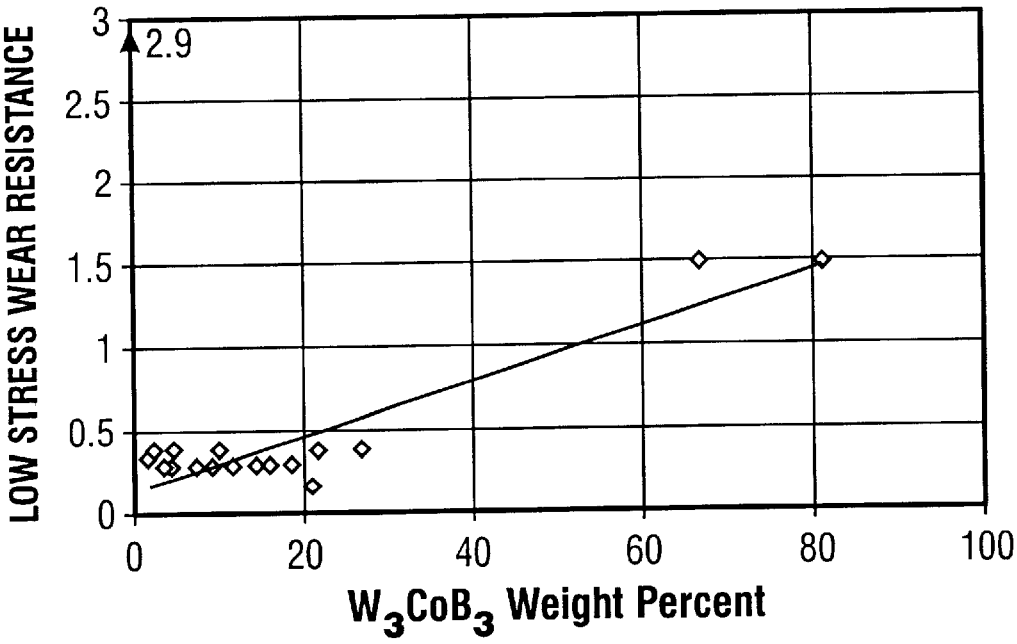
FIG. 5A is a graph showing the relationship between the low-stress wear resistance of a boronized WC substrate and the $W_3CoB_3$ weight percentage in the boride layer according to one embodiment of the invention.
Figure 5B:
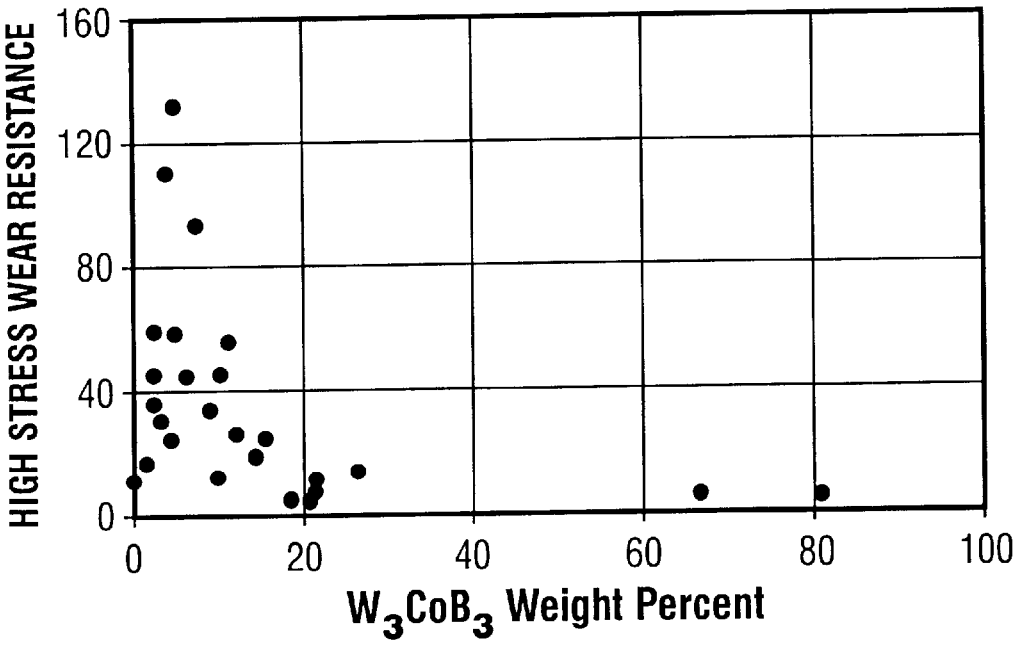
FIG. 5B is a graph showing the relationship between the high-stress wear resistance of a boronized WC substrate and the $W_3CoB_3$ weight percentage in the boride layer according to one embodiment of the invention.

The formation of $W_3CoB_3$ also improves the wear resistance of boronized tungsten carbide. As can be seen from Table 4 and FIG. 5A, a substantial improvement on low-stress abrasion wear resistance is obtained when the $W_3CoB_3$ weight content in a boride layer is less than approximately 25%. On the other hand, a boride layer containing $W_3CoB_3$ in the range of about 2% to about 16% by weight has better resistance to high-stress abrasion wear. This is shown in FIG. 5B. Therefore, the $W_3CoB_3$ weight content in a boride layer preferably should be in that range.

Figure 6A:
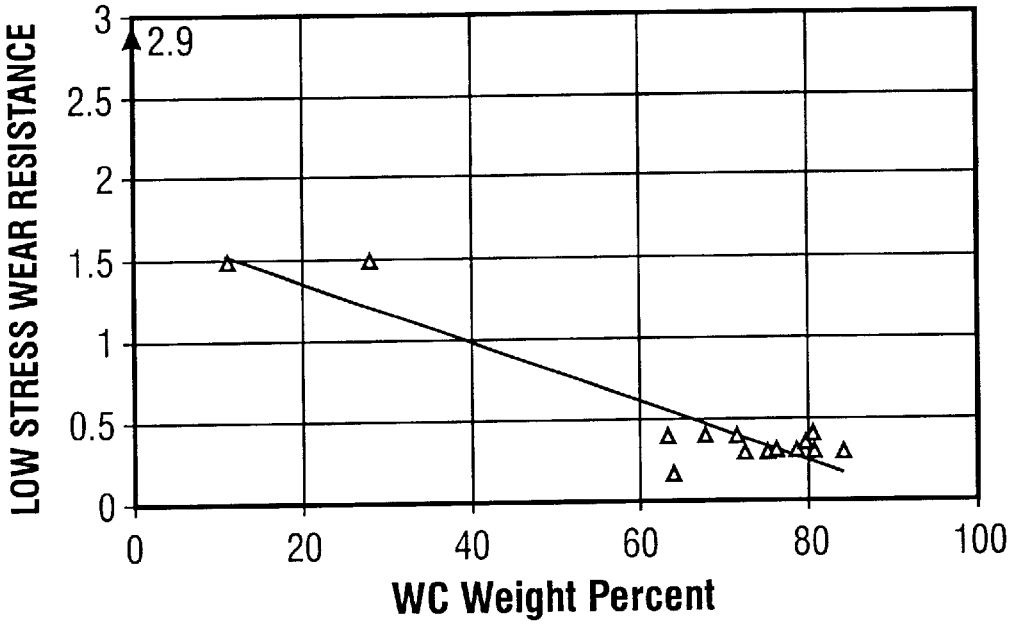
FIG. 6A is a graph showing the relationship between the low-stress wear resistance of a boronized WC substrate and the WC weight percentage in the boride layer according to one embodiment of the invention.
Figure 6B:
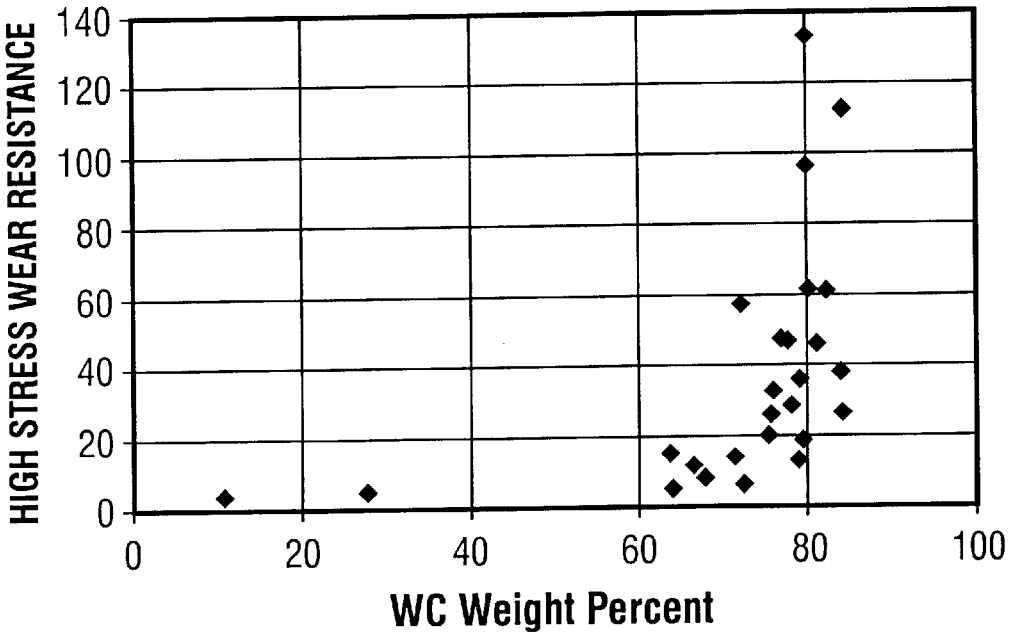
FIG. 6B is a graph showing the relationship between the high-stress wear resistance of a boronized WC substrate and the WC weight percentage in the boride layer according to one embodiment of the invention.

It is further found that the wear resistance of a boride layer is affected not only by the contents of CoB and $W_3CoB_3$, but also by the content of WC. This is confirmed by the data in Table 4. The data in Table 4 and FIGS. 6A and 6B indicate that a WC content greater than approximately 60% by weight in a boride layer is preferred to yield a substantial increase in both high-stress wear resistance and low-stress wear resistance.

TABLE 4

Correlation of WC, $W_3CoB_3$, and CoB Contents In Boride Layer With High-stress And Low-stress Abrasion Wear

| Sample No. | WC Weight Percent | $W_3CoB_3$ Weight Percent | WB | CoB | Low-Stress Wear Number | High-Stress Wear Number |
|---|---|---|---|---|---|---|
| 1 | 83.8 | 4.92 | 0 | 11.26 | 0.3 | 25.5 |
| 2 | 80.3 | 7.86 | 0 | 11.75 | 0.3 | 94.9 |
| 3 | 72.0 | 11.75 | 0 | 15.65 | 0.3 | 56.4 |
| 4 | 79.3 | 2.1 | 1.5 | 17.0 | 0.35 | 17.9 |
| 5 | 80.3 | 2.84 | 1.4 | 15.4 | 0.4 | 60.6 |
| 6 | 79.9 | 5.35 | 0 | 14.75 | 0.4 | 132.5 |
| 7 | 78.6 | 9.5 | 0 | 11.9 | 0.3 | 34.8 |
| 8 | 75.6 | 16.0 | 0 | 8.44 | 0.3 | 25.2 |
| 9 | 63.0 | 27 | 0 | 10.0 | 0.4 | 14.6 |
| 10 | 67.5 | 21.9 | 0 | 10.7 | 0.4 | 7.7 |
| 11 | 75.0 | 14.9 | 0 | 10.0 | 0.3 | 19.5 |
| 12 | 75.8 | 3.8 | 1.5 | 18.9 | 0.3 | 32 |
| 13 | 10.5 | 81.0 | 0 | 8.0 | 1.5 | 4.9 |
| 14 | 72.4 | 19.1 | 0 | 8.4 | 0.3 | 5.5 |
| 15 | 27.4 | 67.0 | 0 | 5.5 | 1.5 | 4.8 |
| 16 | 63.6 | 21.2 | 0 | 15.3 | 0.2 | 5.1 |
| 17 | 71.0 | 10.4 | 0 | 18.8 | 0.4 | 13.4 |
| 18 | 77.5 | 2.9 | 2.6 | 17.3 | n/a | 46.1 |
| 19 | 82.1 | 5.6 | 2.7 | 9.6 | n/a | 59.8 |
| 20 | 76.9 | 10.8 | 0 | 12.3 | n/a | 46.6 |

TABLE 4-continued

Correlation of WC, $W_3CoB_3$, and CoB Contents In Boride Layer With High-stress And Low-stress Abrasion Wear

| Sample No. | WC Weight Percent | $W_3CoB_3$ Weight Percent | WB | CoB | Low-Stress Wear Number | High-Stress Wear Number |
|---|---|---|---|---|---|---|
| 21 | 78.8 | 0.0 | 3.2 | 18.0 | n/a | 12.3 |
| 22 | 83.6 | 2.9 | 1.6 | 11.87 | n/a | 36.8 |
| 23 | 84.5 | 4.5 | 1.6 | 9.4 | n/a | 111.1 |
| 24 | 81.0 | 7.0 | 1.5 | 10.6 | n/a | 45.5 |
| 25 | 78.0 | 12.6 | 0 | 9.3 | n/a | 27.2 |
| 26 | 66.2 | 22.1 | 0 | 11.7 | n/a | 11.3 |
| Reference (Grade 416) | 84% | 0% | 0% | 0% | 2.9 | 2.2 |

EXAMPLE 4

This example illustrates the effect of the cobalt content and the WC grain size in a cemented carbide substrate upon the wear resistance of a resulting boronized carbide. In this example, a series of WC/Co coupons of different grades were boronized at about 880° C. for about eight hours. The carbide grades encompassed the cobalt content from about 8% to 16% and the WC grain size from approximately 1 micron to approximately 6 microns. These samples were subjected the high-stress wear abrasion test. Table 5 is a summary of the testing results.

TABLE 5

Correlation of Composition of WC Substrate With Wear Resistance of Boride Layer

| Sample No. | WC grain size | High-Stress Wear number |
|---|---|---|
| 27 | 2 | 76.5 |
| 28 | 3 | 158.6 |
| 29 | 6 | 10.8 |
| 30 | 3 | 156 |
| 31 | 4 | 15 |
| 32 | 6 | 6.9 |
| 33 | 4 | 32.3 |
| 34 | 6 | 5.4 |
| 35 | 8 | 3.3 |
| Reference (Grade 416) | 4 | 2.9 |

Figure 7:
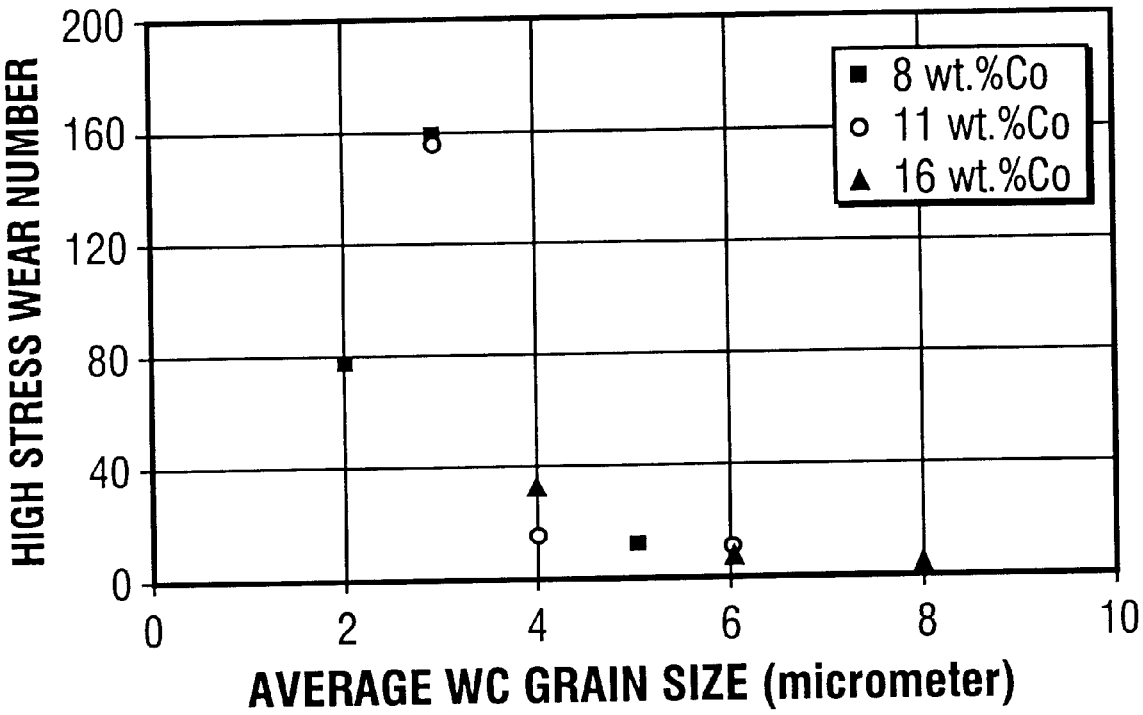
FIG. 7 is a graph showing the relationship between the high-stress wear resistance of a boronized WC substrate and the average WC grain size of the WC substrate according to one embodiment of the invention.

FIG. 7 is a graph based on the data in Table 5 and shows the relationship between high-stress wear resistance of boronized WC substrates and the average WC grain size of the WC substrates. FIG. 7 appears to indicate that the composition of the starting material, i.e., the carbide substrate material, has some effects on the boronizing process and the thus on the wear resistance of the resulting boride layer. Preferably, the average grain size of the tungsten carbide in a starting material or substrate material should fall between about 1 micron to about 6 micron. It should be understood that this particle size designation refers to the average grain size, not the actual WC particle sizes.

As can be seen, boronizing a carbide substrate in accordance with embodiments of the invention produces a wear-resistant body which includes a boride layer over the carbide substrate. Although cemented tungsten carbide in a cobalt matrix was employed in most embodiments, cemented tungsten carbide in other matrixes also may be employed. For example, it should be feasible to boronize tungsten carbide in a nickel matrix, tungsten carbide in an iron matrix, and tungsten carbide in an alloy formed from nickel, cobalt, and iron. When cemented tungsten carbide in a nickel matrix is boronized according to embodiments of the invention, $W_3NiB_3$ should form in the resulting boride layer. Similarly, when cemented tungsten carbide in an iron matrix is boronized, $W_3FeB_3$ also should form in the resulting boride layer. Therefore, embodiments of the invention provide a new boron-containing composition that includes tungsten carbide and one or more compounds represented by the formula $W_3MB_3$, where M is selected from the group consisting of nickel, iron, and cobalt.

In addition to the new boron-containing composition, embodiments of the invention also provide a wear-resistant body or structure that includes a boride layer over a carbide substrate, and the boride layer includes WC and a compound represented by the formula $W_3MB_3$. Because the wear-resistant body has increased wear resistance, toughness, and/or strength, it should have widespread applications. For example, it may be used as wear components in any mechanical apparatus or equipment. It also may be used as a bearing surface or a face seal. Furthermore, wear-resistant nozzles may be formed from boronized carbide in accordance with embodiments of the invention.

Of particular interest, the boronized carbide may be used to make cutting inserts or elements for metal-cutting and earth-boring. For example, a rock bit may be constructed using a boronized tungsten carbide insert. Such a boronized insert includes an inner core and an outer layer which is an integral part of the insert. While the inner core is formed of a suitable carbide, the outer layer is boride layer that includes a compound represented by the formula $W_3MB_3$, where M is selected from the group consisting of nickel, iron, cobalt, and alloys thereof. Such an insert may be manufactured by providing a carbide insert and boronizing the carbide insert according to embodiments of the invention. After boronizing, the insert is cleaned and attached to a rock bit.

Figure 3A:
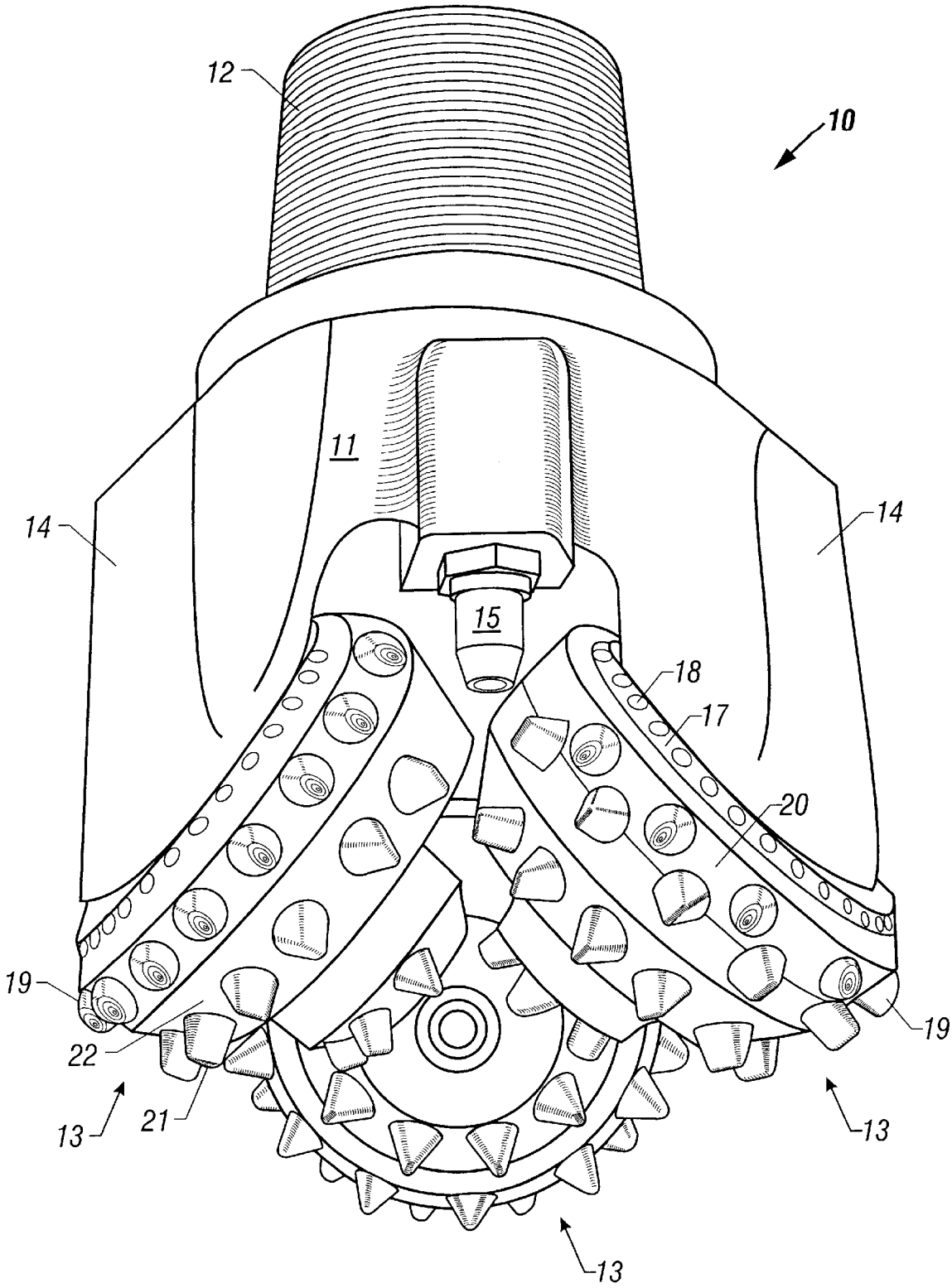
FIG. 3A is a perspective view of a rock bit manufactured in accordance with an embodiment of the invention.
Figure 3B:
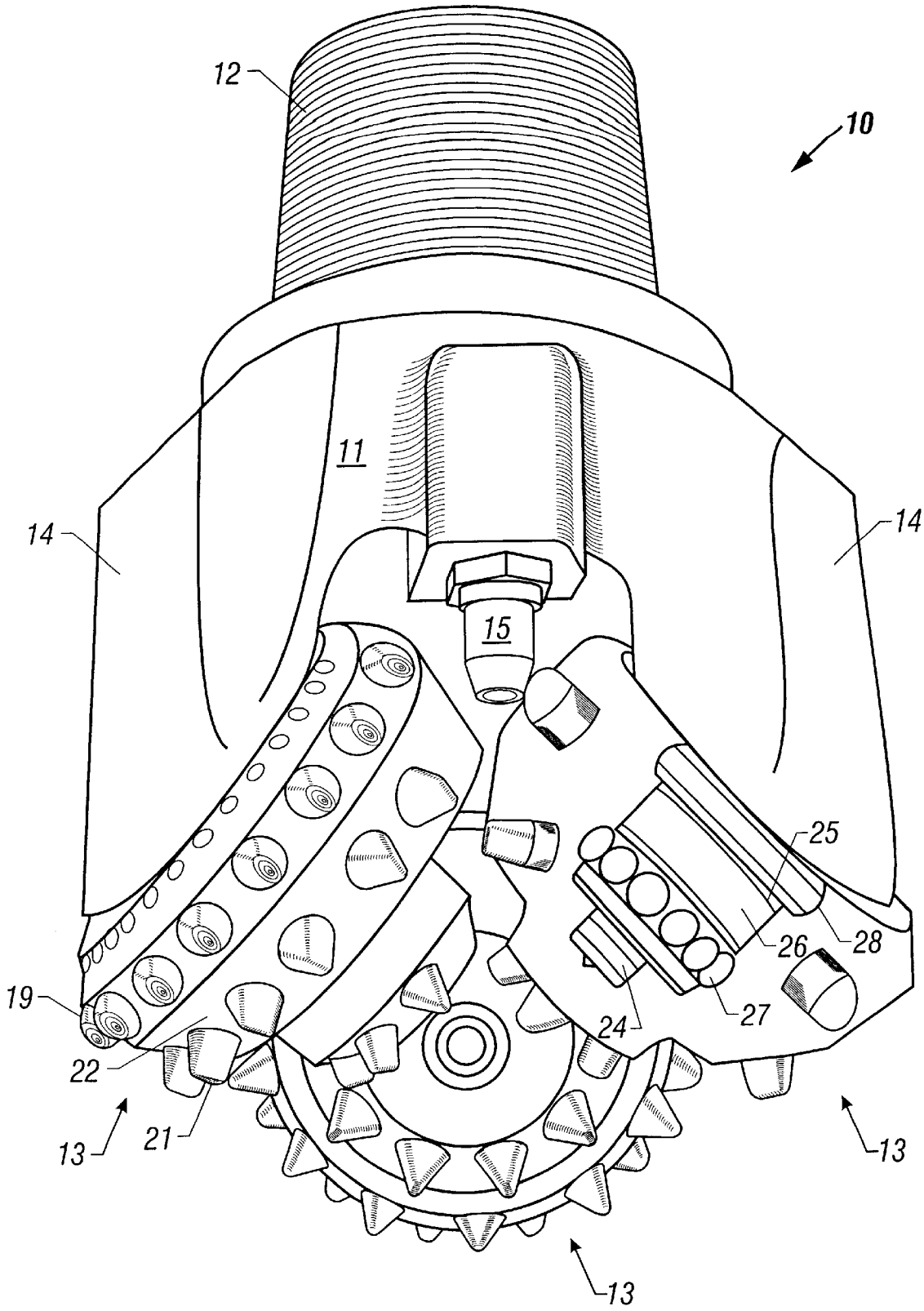
FIG. 3B shows a partial cut-away of one of the roller cones of the rock bit of FIG. 3A.

FIG. 3A shows a perspective view of a rock bit constructed with the boronized inserts according to embodiments of the invention. FIG. 3B is a partial cut-away of one of the roller cones of the rock bit of FIG. 3A. A rock bit 10 includes a bit body 11, having a threaded section 12 on its upper end for securing the bit to a drill string (not shown). The bit 10 generally has three roller cones 13 rotatably mounted on bearing shafts or journals 25 that extend from the bit body 11. A friction bearing 26 and a thrust plug 24 generally are provided on the journal 25 to aid rotation of the roller cone 13 about the journal 25. In addition, there is a plurality of ball bearings 27 between the roller cone 13 and the journal 25. An 0-ring 28 may be used to seal the bearing system.

The bit body 11 is composed of three sections or legs 14 (two legs are shown) that are welded together to form the bit body. The bit 10 further includes a plurality of nozzles 15 that are provided for directing drilling fluid toward the bottom of a bore hole and around the roller cones 13.

Generally, the roller cones 13 include a frustoconical surface 17 that is adapted to retain heel row inserts 18 that scrape or ream the side walls of a borehole as the roller cones rotate about the bore hole bottom. The frustoconical surface 17 is referred to herein as the heel surface of the roller cone, although the same surface sometimes may be referred to by others in the art as the gage surface of the roller cone.

In addition to the heel row inserts, the roller cone 13 further includes a circumferential row of gage inserts 19 secured to the roller cone in locations along or near the circumferential shoulder 20 that cut and ream the borehole wall to a full-gage diameter. The roller cone 13 also includes a plurality of inner row inserts 21 secured to the roller cone surface 22. These inner row inserts usually are arranged and spaced apart in respective rows. Generally, these inserts are not recessed in their respective insert holes. However, in some instances, the inserts may be recessed.

It is apparent that the boronized inserts according to embodiments of the invention may be used as gage row inserts, heel row inserts, inner row inserts, and other inserts. Furthermore, the wear-resistant body according to the embodiments of the invention may be used to manufacture any wear component, such as the nozzle, the bearing face, the thrust plug of a rock bit. Although a petroleum rock bit is illustrated in FIG. 3, a mining rock bit may be manufactured in a similar manner. A mining rock bit typically is used to drill relatively shallow blast holes with air being used as the drilling fluid.

As demonstrated above, embodiments of the invention provide a wear-resistant body with increased wear resistance, toughness, and/or strength. Such a wear-resistant body may be used as an insert (i.e., a boronized insert) for a rock bit. Rock bits incorporating such boronized inserts should experience longer lifetime, higher drilling footage, and a higher rate of penetration in operation. Other properties and advantages may be apparent to a person of ordinary skill in the art.

While the invention has been disclosed with respect to a limited number of embodiments, numerous modifications and variations therefrom are possible. For example, the wear-resistant body and boronized inserts may be used in any wear-resistant application, not just those described herein. Specifically, the wear-resistant body may be used to manufacture cutting tools, drawing dies, and wear parts. It should be noted that suitable methods to produce the boron-containing compound that includes WC and $W_3MB_3$ are not limited to the described methods. For example, ion implementation of boron atom into a carbide substrate may be a feasible method to produce the wear-resistant body. Other boronizing agents also may be used. With respect to methods to practice the invention, it should be understood that any order of steps to achieve the results or the objects of the invention may be employed. It is intended that appended claims cover all such modifications and variations as fall within the true spirit and scope of the invention.

What is claimed is:

1. A boron-containing composition, obtained by the method comprising:

providing a substrate formed of cemented tungsten carbide in a cobalt matrix;

contacting the substrate with a boron-yielding material, an activator and a filler; and heating the substrate and the boron-yielding material to at least 800° C. for at least 8 hours so as to allow boron to molecularly diffuse into the substrate and form a boride layer integral with the substrate, wherein the boride layer comprises a compound having the formula $W_3CoB_3$.

2. A wear-resistant body, comprising:

a substrate; and a boride layer formed integral with the substrate, the boride layer having a compound represented by the formula $W_3CoB_3$.

3. The wear-resistant body of claim 2, wherein the boride layer further includes CoB, $W_2CoB_2$, and WB.

4. The wear-resistant body of claim 3, wherein the boride layer further includes tungsten carbide.

5. The wear-resistant body of claim 4, wherein the weight percent of $W_3CoB_3$ in the boride layer exceeds about 2%.

6. The wear-resistant body of claim 4, wherein the weight percent of $W_3CoB_3$ in the boride layer is up to about 16%.

7. The wear-resistant body of claim 4, wherein the weight percent of $W_3CoB_3$ in the boride layer is in the range of about 2% to about 16%.

8. The wear-resistant body of claim 4, wherein the weight percent of the tungsten carbide in the boride layer exceeds about 60%.

9. The wear-resistant body of claim 4, wherein the weight percent of the tungsten carbide in the boride layer exceeds about 80%.

10. The wear-resistant body of claim 4, wherein the weight percent of CoB in the boride layer exceeds about 8%.

11. The wear-resistant body of claim 4, wherein the weight percent of CoB in the boride layer is up to about 20%.

12. The wear-resistant body of claim 4, wherein the weight percent of CoB in the boride layer is in the range of from about 8% to 20%.

13. The wear-resistant body of claim 4, wherein the weight percent of WB in the boride layer is up to about 2%.

14. The wear-resistant body of claim 2, wherein the substrate is formed of a carbide in a metallic matrix selected from the group consisting of iron, nickel, cobalt, and alloys thereof.

15. The wear-resistant body of claim 14, wherein the substrate further includes one or more of WC, TaC, VC, and TiC.

16. The wear-resistant body of claim 3, wherein the substrate is formed of cemented tungsten carbide in a cobalt matrix.

17. The wear-resistant body of claim 16, wherein the average grain size of the tungsten carbide in the substrate exceeds about 1 micron.

18. The wear-resistant body of claim 16, wherein the average grain size of the tungsten carbide in the substrate is up to about 6 microns.

19. The wear-resistant body of claim 16, wherein the average grain size of the tungsten carbide in the substrate is in the range of about 1 micron to about 6 microns.

20. The wear-resistant body of claim 2, wherein the substrate and the boride layer form a face seal.

21. The wear-resistant body of claim 2, wherein the substrate and the boride layer form a bearing surface.

22. The wear-resistant body of claim 2, wherein the substrate and the boride layer form a thrust plug.

23. The wear-resistant body of claim 2, wherein the substrate and the boride layer form a nozzle.

24. The wear-resistant body of claim 2, wherein the substrate and the boride layer form a component of a rock bit.

25. A wear-resistant body, comprising:

a substrate formed of cemented carbide in a cobalt matrix; and a boride layer formed integral with the substrate, wherein the integral boride layer comprises $W_3CoB_3$ and at least one compound selected from the group consisting of WC, CoB, $W_2CoB_2$, and WB.

26. A wear-resistant body, obtained by the method comprising:

providing a substrate formed of cemented tungsten carbide in a cobalt matrix;

contacting the substrate with a boron-yielding material, an activator, and a filler; and heating the substrate and the boron-yielding material to at least 800° C. for at least 8 hours so as to allow boron to molecularly diffuse into the substrate and form a boride layer integral with the substrate, wherein the boride layer includes tungsten carbide and a compound having the formula $W_3CoB_3$.

27. An insert for an earth-boring bit, comprising:

an inner core formed of a carbide; and an outer layer integral with the inner core, the outer layer including a compound represented by the formula $W_3CoB_3$.

28. The insert of claim 27, wherein the outer layer further includes CoB, $W_2CoB_2$, and WB.

29. The insert of claim 28, wherein the outer layer further includes WC.

30. The insert of claim 29, wherein the weight percent of $W_3CoB_3$ in the outer layer exceeds about 2%.

31. The insert of claim 29, wherein the weight percent of $W_3CoB_3$ in the outer layer is up to about 16%.

32. The insert of claim 29, wherein the weight percent of WC in the outer layer exceeds about 60%.

33. The insert of claim 29, wherein the weight percent of CoB in the outer layer exceeds about 8%.

34. The insert of claim 29, wherein the weight percent of CoB in the outer layer is up to about 20%.

35. The insert of claim 29, wherein the weight percent of WB in the outer layer is up to about 2%.

36. The insert of claim 27, wherein the carbide is dispersed in a metallic matrix selected from the group consisting of iron, nickel, cobalt, and alloys thereof.

37. The insert of claim 36, wherein the carbide includes one or more of WC, TaC, VC, and TiC.

38. The insert of claim 27, wherein the insert is used in an earth-boring bit to form a borehole.

39. An insert obtained by the method comprising:

providing an insert formed of cemented tungsten carbide in a cobalt matrix;

contacting the insert with a boron-yielding material, an activator, and a filler; and heating the insert and the boron-yielding material to at least 800° C. for at least 8 hours so as to allow boron to molecularly diffuse into the insert and form an integral boride layer on the insert, wherein the integral boride layer comprises tungsten carbide and a compound having the formula $W_3CoB_3$.

40. An earth-boring bit, comprising:

a bit body having a leg;

a roller cone rotatably mounted on the leg; and an insert protruding from the roller cone, the insert having an inner core formed of a carbide and an outer layer integral with the inner core, the outer layer including a compound represented by the formula $W_3CoB_3$.

41. A method of making a boron-containing composition comprising:

providing cemented tungsten carbide in a cobalt matrix;

contacting the cemented tungsten carbide with a boron-yielding material, an activator, and a filler; and heating the cemented tungsten carbide and the boron-yielding material to at least 800° C. for at least 8 hours so as to allow boron to molecularly diffuse into the cemented tungsten carbide and form a boride layer integral with the cemented tungsten carbide, wherein the boride layer comprises a compound having the formula $W_3CoB_3$.

42. The method of claim 41, wherein an activator and a filler are used when the cemented tungsten carbide is contacted with the boron-yielding material.

43. The method of claim 42, wherein the boron-yielding material is selected from the group consisting of boron carbide, ferroboron, and amorphous boron.

44. The method of claim 42, wherein the activator is selected from the group consisting of $NABF_4$, $KBF_4$, $(NH_4)_3BF_4$, $NH_4Cl$, $Na_2CO_3$, $BaF_2$, and $Na_2B_4O_7$.

45. The method of claim 42, wherein the filler is selected from the group consisting of SiC, C, and $Al_2O_3$.

46. A method of making a wear-resistant body, comprising:

providing a substrate formed of cemented tungsten carbide in a cobalt matrix;

contacting the substrate with a boron yielding material, an activator and a filler; and heating the substrate and the boron-yielding material to at least 800° C. for at least 8 hours so as to allow boron to molecularly diffuse into the substrate and form a boride layer integral with the substrate, wherein the boride layer includes tungsten carbide and a compound having the formula $W_3CoB_3$.

47. The method of claim 46, wherein the substrate is an insert.

48. A method of making a rock bit, comprising:

providing an insert formed of cemented tungsten carbide in a cobalt matrix;

contacting the insert with a boron-yielding material, an activator, and a filler;

heating the insert and the boron-yielding material to at least 800° C. for at least 8 hours so as to allow boron to molecularly diffuse into the insert and form a boronized insert having an integral boride layer as an outer surface, the boride layer including tungsten carbide and a compound having the formula $W_3CoB_3$;

securing a portion of the boronized insert in a roller cone; and rotatably mounting the roller cone to a leg attached to a bit body.

49. A boron-containing composition, obtained by the method comprising:

providing a substrate formed of cemented tungsten carbide in a cobalt matrix;

contacting the substrate with a boron-yielding material, an activator, and a filler; and heating the substrate and the boron-yielding material to at least 800° C. for at least 8 hours so as to allow boron to molecularly diffuse into the substrate and form a boride layer integral with the substrate, wherein the boride layer comprises a compound having the formula $W_3MB_3$, where M is selected from the group consisting of Co, Fe, and Ni.

50. A wear-resistant body, comprising:

a substrate; and a boride layer formed integral with the substrate, the boride layer having a compound represented by the formula $W_3MB_3$, where M is selected from the group consisting of Co, Fe, and Ni.

51. A wear-resistant body, obtained by the method comprising:

providing a substrate formed of cemented tungsten carbide in a cobalt matrix;

contacting the substrate with a boron-yielding material, an activator, and a filler; and heating the substrate and the boron-yielding material to at least 800° C. for at least 8 hours so as to allow boron to molecularly diffuse into the substrate and form a boride layer integral with the substrate, wherein the boride layer includes tungsten carbide and a compound having the formula $W_3MB_3$, where M is selected from the group consisting of Co, Fe, and Ni.

52. A method of making a boron-containing composition, comprising:

providing cemented tungsten carbide in a cobalt matrix;

contacting the cemented tungsten carbide with a boron-yielding material, an activator, and a filler; and heating the cemented tungsten carbide and the boron-yielding material to at least 800° C. for at least 8 hours so as to allow boron to molecularly diffuse into the cemented tungsten carbide and form a boride layer integral with the cemented tungsten carbide, wherein the boride layer comprises a compound having the formula $W_3MB_3$, where M is selected from the group consisting of Co, Fe, and Ni.

53. A method of making a rock bit, comprising:

providing an insert formed of cemented tungsten carbide in a cobalt matrix;

contacting the insert with a boron-yielding material, an activator, and a filler;

heating the insert and the boron-yielding material to at least 800° C. for at least 8 hours so as to allow boron to molecularly diffuse into the insert and form an integral boride layer as an outer surface, the boride layer including tungsten carbide and a compound having the formula $W_3MB_3$, where M is selected from the group consisting of Co, Fe, and Ni;

securing a portion of the boronized insert in a roller cone; and rotatably mounting the roller cone to a leg attached to a bit body.

* * * * *